US006494619B1

(12) United States Patent
Sulpizio

(10) Patent No.: US 6,494,619 B1
(45) Date of Patent: Dec. 17, 2002

(54) DISPOSABLE LAWN BAG

(76) Inventor: Alfred Sulpizio, 1206 Waverly Walk, Philadelphia, PA (US) 19147

( * ) Notice: Subject to any disclaimer, the term of this patent is extended or adjusted under 35 U.S.C. 154(b) by 0 days.

(21) Appl. No.: 09/585,039

(22) Filed: Jun. 1, 2000

Related U.S. Application Data

(60) Provisional application No. 60/137,920, filed on Jun. 7, 1999.

(51) Int. Cl.[7] ..... B65D 30/10

(52) U.S. Cl. ..... 383/33; 383/104; 248/99; 141/390

(58) Field of Search ..... 383/33, 43, 119, 383/104; 248/99; 220/495.11; 141/390, 391

(56) References Cited

U.S. PATENT DOCUMENTS

| | | | | | |
|---|---|---|---|---|---|
| 2,295,584 | A | * | 9/1942 | Larson | 383/33 X |
| 2,342,324 | A | * | 2/1944 | Allen | 383/119 X |
| 2,494,446 | A | * | 1/1950 | Moore | 383/119 X |
| 2,556,321 | A | * | 6/1951 | Denton | 383/33 |
| 2,773,636 | A | * | 12/1956 | Williams et al. | 383/119 X |
| 2,873,905 | A | * | 2/1959 | Denton | 383/119 X |
| 3,148,799 | A | * | 9/1964 | Meroney | 220/495.11 |
| 3,249,286 | A | * | 5/1966 | Palmer | 383/109 |
| 3,262,629 | A | * | 7/1966 | Murphy et al. | 383/119 X |
| 3,533,807 | A | * | 10/1970 | Wakefield | 383/33 X |
| 3,822,524 | A | * | 7/1974 | Jerpbak | 53/459 |
| 3,896,991 | A | * | 7/1975 | Kozlowski et al. | 383/116 |
| 3,915,329 | A | * | 10/1975 | Zaks | 141/390 |
| 3,957,195 | A | * | 5/1976 | Lin | 383/119 X |
| 3,983,914 | A | * | 10/1976 | Benson | 141/390 |
| 4,064,302 | A | * | 12/1977 | Kozlowski et al. | 428/152 |
| 4,284,205 | A | * | 8/1981 | Hirata | 229/154 |
| 4,317,478 | A | * | 3/1982 | Babbidge | 383/43 |
| 4,457,483 | A | * | 7/1984 | Gagne | 248/97 |
| 4,628,007 | A | * | 12/1986 | Ledsham | 428/542.8 |
| 4,664,348 | A | * | 5/1987 | Corsaut, III et al. | 248/99 |
| 4,940,200 | A | * | 7/1990 | Sawyer et al. | 248/99 X |
| 5,037,138 | A | * | 8/1991 | McClintock et al. | 383/43 X |
| 5,056,679 | A | * | 10/1991 | Lonczak | 141/390 |
| 5,082,219 | A | * | 1/1992 | Blair | 248/99 |
| 5,132,124 | A | * | 7/1992 | Tamaki et al. | 383/33 X |
| 5,160,196 | A | * | 11/1992 | Curtis | 383/33 |
| 5,363,980 | A | * | 11/1994 | Mulcahy | 220/495.11 X |
| 5,425,468 | A | * | 6/1995 | Birkel et al. | 220/495.11 |
| 5,593,117 | A | * | 1/1997 | Alexander, III | 383/33 X |
| 5,743,651 | A | * | 4/1998 | Steinmetz | 383/33 |
| 5,897,084 | A | * | 4/1999 | Judge | 248/99 X |
| 6,022,144 | A | * | 2/2000 | Hausslein | 383/33 |

FOREIGN PATENT DOCUMENTS

| | | | | |
|---|---|---|---|---|
| GB | 2 241 220 | * | 8/1991 | 383/33 |

* cited by examiner

*Primary Examiner*—Jes F. Pascua
(74) *Attorney, Agent, or Firm*—Akin, Gump, Strauss, Hauer & Feld, L.L.P.

(57) ABSTRACT

A device is disclosed for holding open the mouth of a bag. The device comprises a strip of light weight, generally stiff material having a predetermined length generally corresponding to the circumference of the mouth of the bag. The strip of material has a predetermined height and a predetermined thickness which is sufficient to provide vertical support. The strip of material is secured around a surface of the bag proximate to the mouth of the bag, such that when the bag is placed on a supporting surface, the strip of material supports and maintains the mouth of the bag in an open condition.

6 Claims, 2 Drawing Sheets

DISPOSABLE LAWN BAG

CROSS REFERENCE TO RELATED APPLICATIONS

This application claims priority from U.S. Provisional Patent Application No. 60/137,920, filed Jun. 7, 1999 and entitled "Bag Mouth Opening Device."

BACKGROUND OF THE INVENTION

The present invention relates to devices simplifying the use of bags, such as polymeric trash bags and, more specifically, to a mouth opening device for use with a bag.

It is often difficult to use a bag while performing various chores due to the necessity of holding the mouth of the bag in an opened position while placing objects into the bag. One example of the difficulty of holding a bag open during the filling process is trying to hold a large polymeric bag open while filling the bag with leaves. After assembling the fallen leaves into piles, it is necessary to lift the leaves and then place them into a bag for disposal. However, this seemingly simple task is often complicated by a tendency for the mouth of the bag to collapse, thus preventing the leaves or other objects from being easily placed into the bag. Thus, while holding the leaves that need to be deposited in the bag, one must also manipulate the bag to hold open the bag's mouth. This results in leaves being dropped during the process of loading the leaves into the bag. Accordingly, extra repetitions of picking up a grouping of leaves, opening the bag, and placing the leaves into the bag must be performed. This results in increased frustration as well as an increased probability of injury due to overexertion.

While metal stands or frame-like devices are commonly available to support such bags in an open condition, there are many difficulties associated with the use of stands that make bag stands inconvenient to use. For example, most stands are designed for only one type or size of bag. Thus, depending on the particular type of bag for which the stand is designed, it is not feasible to use the stand with other bags. For example, a stand designed for a large outdoor trash bag may be suitable for the collection of leaves, but such a stand would be unusable during a barbecue when the use of a smaller sized bag is desired. Additionally, it is impractical to purchase different stands for each type and size of bag that one commonly uses.

Furthermore, once a bag is full and bulging from the sides it is difficult to lift the bag up from a stand without knocking over the stand or otherwise getting the bag caught in the stand.

Additionally, the use of most stands requires that a portion of the bag material overlap an outer lip of the stand to prevent the bag from falling from the top of the stand such that the overall volume of the bag that can be filled is reduced. This prevents the bag from being fully utilized without separately removing the bag from the stand and then manually filling the bag further. This increases the chance of the bag falling over or waste being dropped during the process of depositing more trash into the bag, thus, defeating the purpose of the stand in the first place.

Furthermore, it is often difficult to secure a bag to a stand while loading objects into the bag. Bags commonly fall from the stand each time further objects are placed into the bag. This requires that the bag be repetitively re-secured to the stand during the filling process and results in a less efficient use of time.

The present invention is directed to a mouth opening device that overcomes that above-mentioned problems. The mouth opening device of the present invention is usable with bags of various sizes and eliminates the difficulty of holding the mouth of a bag in an open position while simultaneously placing debris, waste or other item inside of the bag.

The mouth opening device of the present invention can be manufactured separately or can be integral with bags of various types and sizes. Contrary to the stands of the prior art, the preferred embodiment of the mouth opening device allows bags to be filled to their maximum volume. Thus, the present invention increases the convenience with which debris, waste and other items can be placed into a bag, reduces the time necessary to load a bag and thereby reduces the level of fatigue and potential injury associated with bag filling activities.

BRIEF SUMMARY OF THE INVENTION

Briefly stated, the present invention comprises a device for holding open the mouth of a bag. The device comprises a strip of light weight, generally stiff material having a predetermined length generally corresponding to the circumference of the mouth of the bag. The strip of material has a predetermined height and a predetermined thickness which is sufficient to provide vertical support. The strip of material is secured around a surface of the bag, proximate to the mouth of the bag, such that when the bag is placed on a supporting surface, the strip of material supports and maintains the mouth of the bag in an open condition.

BRIEF DESCRIPTION OF THE SEVERAL VIEWS OF THE DRAWINGS

The foregoing summary, as well as the following detailed description of preferred embodiments of the present invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
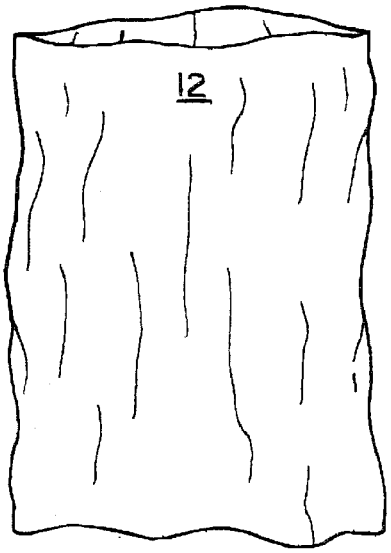
FIG. 1 PRIOR ART
FIG. 1 is a perspective view of a bag according to the prior art.

In the drawings, like numerals are used to indicate like elements throughout the several figures. Certain terminology is used in the following description for convenience only, and is not limiting. The words "right," "left," "lower," and "upper" designates directions in the drawings to which reference is made. The words "inwardly" and "outwardly" refer to directions toward and away from, respectively, the geometric center of the mouth opening device and designated parts thereof. The terminology includes the words above specifically mentioned, derivatives thereof and words of similar import.

Figure 2:
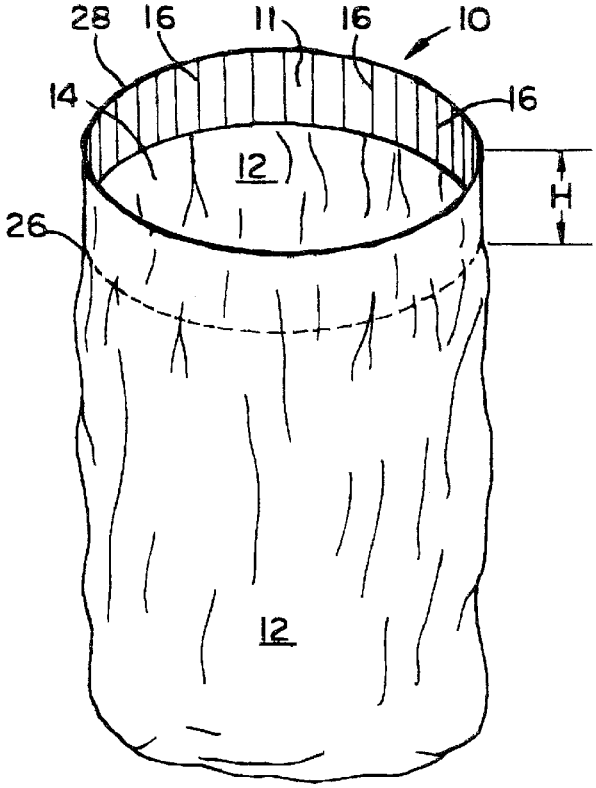
FIG. 2 is a perspective view of a first embodiment of a mouth opening device according to the present invention secured to the mouth of the bag of FIG. 1.

Referring to FIGS. 1–7, preferred embodiments of a mouth opening device in accordance with the present invention, are generally designated 10. FIG. 1 illustrates a bag 12 of a type which may be used with the bag mouth opening device 10. The bag 12, as illustrated is a standard size (20 or 30 gallon) polymeric trash bag of a type well known in the art and generally available. It should be understood that the present invention may be used with bags made of some other material such as paper, fabric, etc. or with bags of some other size. The mouth opening device 10 is preferably positioned around the interior surface of a bag 12 proximate to or along the open edge of the bag that forms the mouth 14. If desired, the mouth opening device 10 could be positioned around the exterior surface of the bag 12. Thus, the mouth opening device 10 supports and maintains the mouth 14 of the bag 12 in an open position when placed on the ground or some other supporting surface, as shown in FIG. 2. This simplifies the loading of objects into the bag 12.

Referring to FIG. 2, the mouth opening device 10 preferably is formed of a strip of material with the strip ends secured together to form a generally tubular shape. However, it should understood by those of skill in the art from this disclosure that the mouth opening device 10 can be designed to have various shapes, such as a rectangular or an octagonal shape. When an empty bag 12 having an attached mouth opening device 10 is placed on the ground (or other supporting surface) the lower edge 26 of the mouth opening device 10 is supported by the ground with only the material of the bag 12 positioned therebetween. From the point of contact between the lower edge 26 of the mouth opening device 10, the material of the bag 12, and the ground, the mouth opening device 10 extends generally vertically upwardly toward an upper edge 28 of the mouth opening device 10. Thus, the mouth opening device 10 forms a generally ring-shaped collar that effectively maintains the mouth 14 of the bag 12 in an open position as shown.

A first embodiment of the mouth opening device 10 is shown in FIG. 2. In this embodiment, the mouth opening device 10 is manufactured with the bag 12 as a single unit. The mouth opening device 10 is preferably secured to the bag 12 using a standard adhesive. However, it should be understood by those of skill in the art from this disclosure that the present invention is not limited to a particular method of attaching the mouth opening device 10 to the bag 12. For instance, a heat seal arrangement can be used to attach the mouth opening device 10 to the bag 12. Alternatively, the mouth opening device 10 can be enclosed within a sleeve of the material of the bag 12 that is adjacent to the mouth 14.

The mouth opening device 10 of the present invention is preferably used with polymeric or plastic bags. However, it is understood by those of skill in the art from this disclosure that the present invention is not limited to any particular type of bag 12. For example, the mouth opening device 10 can be used with bags manufactured from a cloth or synthetic fabric, such as burlap or nylon and the like.

The height, denoted "H," of the mouth opening device 10 is preferably 5 inches. However, it should be understood by those of skill in the art through this disclosure that the present invention is not limited to a mouth opening device 10 having any particular height "H." For example, it may be desirable to use a mouth opening device 10 having a larger height "H," such as 8–10 inches, in conjunction with larger bags and it may be desirable to use a mouth opening device 10 having a smaller height "H," such as 1–2 inches, when using smaller sized bags. Accordingly, the height "H" of the mouth opening device 10 can be varied according to the particular size and/or use of the bag 12 and according to a consumer's preference.

The mouth opening device 10 is preferably formed of a single strip of light weight, radially inwardly deformable, vertically crush resistant stiff material, such as cardboard or a heavy weight paper such as kraft paper. If kraft paper is used it should preferably be at least two layers thick to provide the needed vertical support. If desired, the material may be accordion folded or otherwise deformed to provide additional vertical support. A single layer of foil may be placed between the two kraft paper layers to provide additional support and to provide a memory to hold the bag closed if desired. However, it should be understood from this disclosure by those of skill in the art that the mouth opening device 10 may be constructed of materials other than kraft paper. For example, the mouth opening device 10 may be constructed of a thin metallic material, a Styrofoam™ material, a foil, a polymer material, or other materials or combinations of materials having suitable light weight, crush resistant, and radially inwardly deformable properties. Preferably, the length of the strip of material used to form the mouth opening device 10 generally corresponds to the circumference of the mouth 14 of the bag 12, but could be slightly greater (i.e. some overlap) or slightly smaller if desired. The thickness of the material used to form the mouth opening device 10 is sufficient to provide the needed vertical support and will vary depending upon the type and stiffness of the material.

Figure 3:
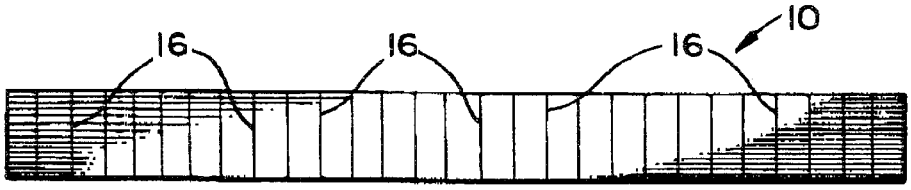
FIG. 3 is a front side elevational view of a second embodiment of a mouth opening device according to the present invention.

Referring to FIGS. 2 and 3, corrugations 16 are preferably formed in the mouth opening device 10 to provide vertical strength and to facilitate the collapsing of the mouth opening device 10 to enable a bag 12, which uses the mouth opening device 10, to be closed. Thus, the corrugations 16 allow one to physically close the mouth 14 of the bag 12 once the bag 12 is filled. The corrugations 16 give the mouth opening device 12 a radially inwardly collapsible structure while simultaneously strengthening the vertical crush resistance of the mouth opening device 10.

In the preferred embodiment, the corrugations 16 are formed by placing accordion-like folds in the material of the mouth opening device 10. However, it should be understood by those of skill in the art through this disclosure that the mouth opening device 10 can be constructed without corrugations 16 and that other methods of imparting radially inwardly collapsibility structure to the mouth opening device 10 may be used without departing from the present invention. For example, perforations 20 (see FIG. 7) can be used to weaken portions of the mouth opening device 10 to allow the mouth opening device 10 to be inwardly radially collapsible.

Referring to FIGS. 3–7, a second embodiment of the mouth opening device 10 according to the present invention is shown. The material and the dimensions of the second embodiment of the mouth opening device 10 are similar to that described in conjunction with the first embodiment of the mouth opening device 10 of FIG. 2.

Figure 4:
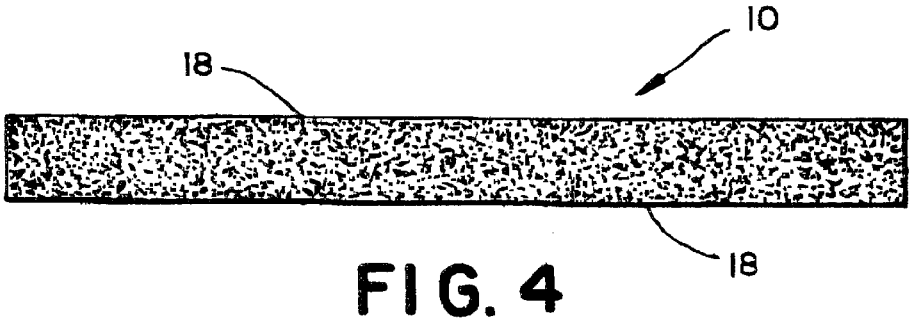
FIG. 4 is a rear elevational view of the mouth opening device of FIG. 3.

Referring to FIG. 4, the mouth opening device 10 is manufactured separately from the bag 12 and has an adhesive layer 18 on a rear surface that is used to affix the mouth opening device 10 around the inner (or outer) surface of a bag 12 proximate to the mouth 14. The tackiness of the adhesive layer 18 is preferably similar to that used with self-adhesive stamps. A release paper (not shown) may be placed over the adhesive layer 18 until the bag opening device 10 is ready to be secured to a bag 12. Thus, the mouth opening device 10 can be pressure-fitted to the inside (or outside) of a bag 12. This facilitates the use of the mouth opening device 10 with a variety of sizes and types of bags 12. Additionally, the mouth opening device 10 of the second embodiment can be selectively used with bags 12 depending on the particular use of the bag 12. Thus, the mouth opening device 10 is only used when necessary instead of being integrated into each individual bag 12 as shown in FIG. 2. Furthermore, the ability of the mouth opening device 10 of FIGS. 3–7 to be used with a variety of sizes of bags 12 increases the number of potential situations in which the mouth opening device 10 is useful. For example, the mouth opening device 10 can be used with a small plastic bag during a picnic and the mouth opening device 10 can also be used with a large outdoor trash bag while removing leaves.

The tackiness of the adhesive layer 18 can be modified for the particular material used to construct the bag 12 for which the mouth opening device 10 is designed. Accordingly, an increased tackiness of the adhesive layer 18 would be used to form a mouth opening device 10 for use with a cloth bag.

Figure 5:
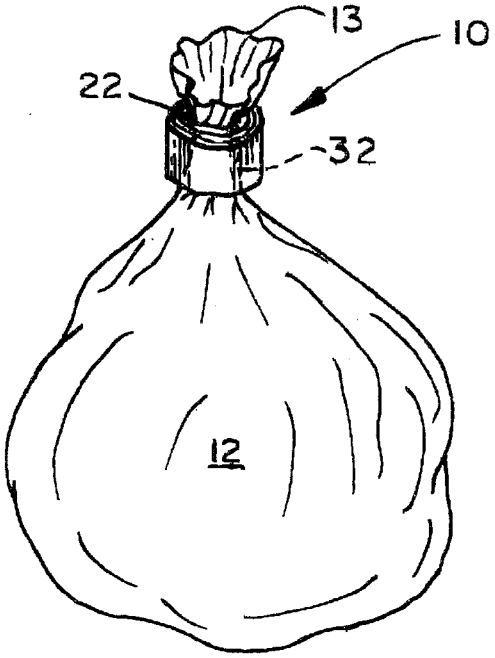
FIG. 5 is a perspective view of the mouth opening device of FIG. 3 configured to secure the mouth of a bag in a closed position.
Figure 6:
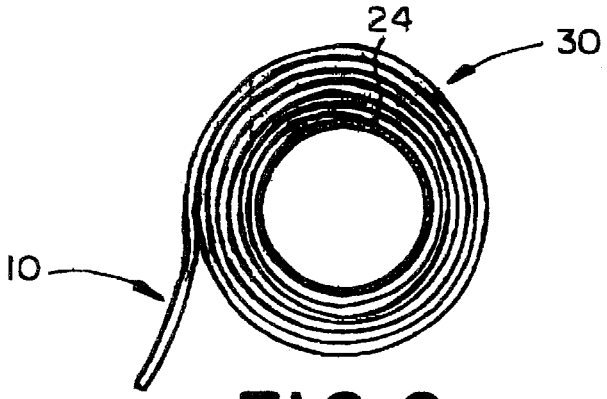
FIG. 6 is a right side elevational view of several of the mouth opening devices of FIG. 3 wrapped around a core to form a dispenser.

Additionally, an adhesive layer 18 can be used that allows the mouth opening device 10 to be attached and thereafter detached from a bag 12 in a manner similar to that of a Post-it™ note. This allows a strip of material of a length corresponding to the circumference of the mouth opening device 10 to be removed from a dispenser 30, as shown in FIG. 6, and secured around the inner (or outer) surface of a bag 12 with the ends of the strip abutting or secured together to form a ring-like shape, similar to that shown in FIG. 2. Then, once the bag 12 is filled, the mouth opening device 10 can be removed from the inner (or outer) surface of the bag 12, the end 13 of the bag gathered into a bunch and the mouth opening device 10 wrapped securely around a neck portion 32 (shown in phantom lines in FIG. 5) of the bag 12. Thus, the mouth opening device 10 forms layers 22 around the bag 12 proximate to the end 13 to secure the bag 12 in the closed position. The second embodiment of the mouth opening device 10 not only secures the mouth 14 of the bag 12 in an open position during the loading process, but can also securely close the mouth 14 of the bag 12 once the bag loading process is finished.

Figure 7:
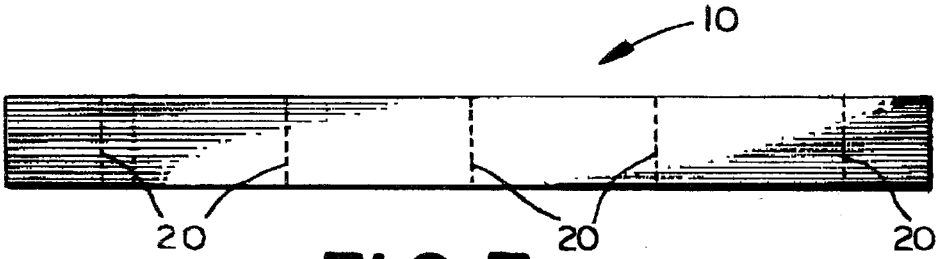
FIG. 7 is a front elevational view of a portion of the mouth opening device of FIG. 3 illustrating perforations in the mouth opening device.

To facilitate the use of the mouth opening device 10 with the dispenser 30 of FIG. 6, perforations 20 (as shown in FIG. 7) can be formed in the strip of material used to form the mouth opening device 10. Accordingly, long strips of the material used for the mouth opening device 10 can be manufactured wrapped around a core 24 to be used as a dispenser 30. Then, the appropriate length of the material corresponding to the circumference of the mouth 14 of the bag 12 can be removed from the dispenser 30 and secured by the adhesive along the inner surface of the bag 12 proximate to the mouth 14. The perforations 20 allow the correct length of material to be easily separated from the dispenser 30 to form an appropriately sized mouth opening device 10 for any size bag 12.

Alternatively, various fixed size strips, such as those shown in FIGS. 3 and 4, can be sold with a release liner (not shown) attached to the adhesive layer 18. Thus, to attach the mouth opening device 10 to a bag 12, the release liner would be removed and the adhesive layer 18 contacted with the inner surface of the bag 12.

Furthermore, depending on the materials used to form the mouth opening device 10, a mouth opening device 10 can be constructed that is completely recyclable. This makes using the mouth opening devices 10 convenient for sealing bags 12 containing other materials that are to be recycled. After arriving at a recycling center, the mouth opening device 10 can be removed from its position securing the bag 12 in a closed position as shown in FIG. 5. Then, the mouth opening device 10 is placed around the inner surface of the bag 12 to hold the mouth 14 of the bag 12 in an open position while various recyclables are removed from the bag 12 and placed into the appropriate recycling bins. Once the various recyclable contents of the bag 12 are placed in the appropriate recycling bins, the mouth opening device 10 can be removed and also placed in a recycling bin.

Alternatively, the mouth opening device 10 may be formed of cloth covered memory material (not shown), such as wire or thin metal, to allow the mouth opening device 10 to automatically cinch a bag 12 closed. The memory material is designed to have a spiral-like shape that is ideal for securing the top of a bag 12 in the closed position. Due to the tendency for the memory material to return to its curled position, the cloth covered memory material may be reversed and wound in an opposite fashion and then released inside the lip of the bag opening. Thus, when the memory material is released, the cloth covered memory material expands in an attempt to return to its spiral position and holds the mouth 14 of the bag 12 in an open position.

Accordingly, the mouth opening device 10 of the present invention, is useful in a variety of situations limited only by the particular materials used to construct the mouth opening device 10 and the bag 12. For example, with an appropriate selection of materials, the mouth opening device 10 and the bag 12 could be used to securely transport food during a canoe trip. While traveling in the canoe the mouth opening device 10 is wrapped around the end 13 of a water resistant bag 12, as shown in FIG. 5. Upon reaching a desirable picnic location, the mouth opening device 10 is removed and placed inside the lip of the mouth 14 of the bag 12 to secure the mouth 14 in an open position, as shown in FIG. 2. Thus, allowing easy access to food that is contained in the bag 12. After the picnic is finished, the mouth opening device 10 is removed, the end 13 of the bag 12 gathered into a bunch, and the mouth opening device 10 securely re-wrapped around the bag 12 to form layers 22 proximate to the end 13 of the bag 12.

In operation, as shown in FIGS. 1–7, the mouth opening device 10 is used as follows. A length of material is removed from a dispenser 30 to form the mouth opening device 10. The mouth opening device 10 is placed along the inner or outer surface of a bag 12 with the ends secured together or abutting each other to form a ring-like collar proximate to the end 13 of the bag 12. Then, the lower edge 26 of the mouth opening device 10 is placed on the ground or other supporting service, in the manner as shown in FIG. 2. Materials are then loaded into the bag 12. As the bag 12 is gradually filled, the objects contained in the bag 12 form a supporting surface for the lower edge 26 of the mouth opening device 10. Thus, the mouth opening device 10 is incrementally raised upwardly in the vertical direction as the bag 12 is correspondingly filled. Once the bag 12 is completely filled, the mouth opening device 10 is detached from the inner surface of the bag 12. Then, the end 13 of the bag 12 is gathered into a bunch and the mouth opening device 10 is wrapped around a necked portion 32 of the bag 12 to form layers 22 securing the end 13 of the bag 12. Thus, the filled bag 12 is conveniently sealed and ready for transport or disposal.

Accordingly, the mouth opening device 10 of the present invention provides increased convenience in the loading, unloading, and securing of bags of all types and sizes. Additionally, the economical design and materials used to form the mouth opening device 10 makes the present invention capable of every day use and likely to become a commonplace household item.

It will be appreciated by those skilled in the art that changes could be made to the embodiments described above without departing from the broad inventive concept thereof. It is understood, therefore, that the mouth opening device 10 is not limited to the particular embodiments disclosed, but it is intended to cover modifications within the spirit and scope of the present invention as set forth in the appended claims.

What is claimed is:

1. In combination, a disposable polymeric lawn bag having a permanently closed end, an open end and a mouth formed at the terminal edge of the open end for receiving lawn and garden debris and a tubular shaped device for holding open the mouth of the lawn bag when the bag is placed on the ground, the device consisting only of an elongated single strip of paper thin, semi-stiff flexible flat material having an upper edge, a lower edge, a predetermined length generally corresponding to the circumference of the mouth of the lawn bag with two ends secured together to form a ring-shaped collar and a predetermined height in the range of five to ten inches to provide vertical support for the lawn bag when the lawn bag is placed on the ground, the strip of material being permanently secured to the lawn bag by one of an adhesive, heat seal and being enclosed within a sleeve with the upper edge at or adjacent to the mouth of the lawn bag so as to become an integral part of the lawn bag such that when the lawn bag is placed on the ground, the lower edge of the strip of material is supported by the ground and the strip of material extends vertically and supports and maintains the mouth of the lawn bag in an open condition to facilitate the loading of lawn and garden debris into the lawn bag.

2. The device as recited in claim 1 wherein the material is paper.

3. The device as recited in claim 2 wherein the paper includes a plurality of corrugations extending along the height of the material.

4. The device as recited in claim 1 wherein the material is a polymer.

5. The device as recited in claim 1 wherein the material is metal.

6. In combination, a disposable polymeric lawn bag having a permanently closed end, an open end and a mouth formed at the terminal edge of the open end for receiving lawn and garden debris and a tubular shaped device for holding open the mouth of the lawn bag, the device consisting only of an elongated single strip of kraft paper an upper edge, having a lower edge, a predetermined length generally corresponding to the circumference of the mouth of the lawn bag with two ends secured together to form a ring-shaped collar, a predetermined height and a predetermined thickness which is sufficient to provide vertical support for the lawn bag when the lawn bag is placed on the ground, the paper strip being permanently secured to the lawn bag by one of an adhesive, heat seal and being enclosed within a sleeve with the upper edge at or adjacent to the mouth of the lawn bag so as to become an integral part of the lawn bag such that when the empty lawn bag is placed on the ground, the lower edge of the paper strip is supported by the ground and the paper strip extends vertically and supports and maintains the mouth of the lawn bag in an open condition to facilitate the loading of lawn and garden debris into the lawn bag.

* * * * *